US006074095A

United States Patent [19]

Bannister et al.

[11] Patent Number: 6,074,095

[45] Date of Patent: Jun. 13, 2000

[54] FOUR MEMBER VALVE CLOSURE ASSEMBLY FOR VALVE BAGS

[75] Inventors: Roger Bannister, Crossett; John D. Aiken; Michael A. Berry, both of Hamburg, all of Ark.

[73] Assignee: Bemis Company, Inc., Minneapolis, Minn.

[21] Appl. No.: 09/251,068

[22] Filed: Feb. 16, 1999

[51] Int. Cl.[7] ..... B65D 33/16

[52] U.S. Cl. ..... 383/54; 383/48

[58] Field of Search ..... 383/44, 48, 53, 383/54

[56] References Cited

U.S. PATENT DOCUMENTS

| | | | |
|---|---|---|---|
| 3,191,850 | 6/1965 | Niemeyer | 383/54 X |
| 4,412,645 | 11/1983 | Lepisto | 383/48 |
| 4,759,640 | 7/1988 | Groner | 383/54 X |

FOREIGN PATENT DOCUMENTS

| | | | |
|---|---|---|---|
| 498047 | 8/1992 | European Pat. Off. | 383/54 |
| 29 35 971 A1 | 9/1979 | Germany . | |
| 1357544 | 6/1974 | United Kingdom | 383/54 |

*Primary Examiner*—Jes F. Pascua
*Attorney, Agent, or Firm*—Lee, Mann, Smith, McWilliams, Sweeney & Ohlson

[57] ABSTRACT

A valve assembly for a satchel end tubular bag comprising four members. Two members form an upper sub-assembly and two other members for a lower sub-assembly. The valve assembly is adhesively secured at a corner tuck of the satchel end within the paper plies of the bag. The upper sub-assembly is wrapped within the lower sub-assembly and forms a passageway for a product injection nozzle to be inserted therethrough for introducing product into the bag. The members of the sub-assemblies are laterally offset and each sub-assembly has said members both laterally and longitudinally offset, or stepped, to achieve strength and a sift-proof construction. Extensions of one of the members of each sub-assembly extend bag-inwardly and comprise a thin pliable material, whereby to provide improved self-closure as the product fills the bag. Both improved filling and sealing are achieved.

24 Claims, 4 Drawing Sheets

FOUR MEMBER VALVE CLOSURE ASSEMBLY FOR VALVE BAGS

BACKGROUND OF THE INVENTION

The present invention is directed to a valve assembly for a bag. More specifically, the valve assembly is directed for use in what the bag-making industry refers to as pasted valve bags of a tubular construction wherein opposite ends are typically provided with satchel ends that are sealed prior to filling except for an opening at the valve assembly itself.

Even with more particularity, the invention is directed toward improvements to four member valve assemblies of the type that are self-closing upon the completion of the filling of the bag.

Prior art four member valve constructions utilizing a two-part upper insert and a two-part lower insert, such as disclosed in German Patent No. 2935971, have achieved a certain degree of success in valve closure effectiveness upon the filling of the bag and the prevention of sifting or dusting caused by blowback around the packing area. Such construction of a four member valve assembly has required two inserts, each of which comprises a paper blank and a substantially thinner plastic film member. The present invention improves upon this type of valve assembly by attaining: greater strength; minimal chance of plies or insert members sticking together caused at the inside by adhesive squeeze-out or bleed through; a better self-closing flap-valve-type closure; and enhanced tear-resistance at the corner ear fold or corner tuck where the valve is located. By enhancing the strength of the valve assembly, tearing, splitting and rupturing during insertion and retraction of a filing nozzle are substantially eliminated. Channeling of the product out of the valve assembly between the valve assembly and the folded plies of the bag is also virtually eliminated. Less drag resistance against the insertion spout or nozzle is also achieved. While the use of a thin plastic for a flap-valve closure, such as with polyethylene film, has achieved a certain degree of effectiveness in the prior art, it is further a goal of the invention to eliminate the utilization of a thin plastic film and provide a four member valve assembly entirely made of paper. It has also been found that it is important to step the members of the upper and lower sub-assemblies of the valve assembly in the lateral direction. This stepping, or shingling, also achieves a greater degree of overlap for each of the upper and lower sub-assemblies extending outside the fold lines of the satchel ends. It has also been discovered that stepping the members of each sub-assembly with respect to each other inwardly of the bag provides improved valve closure. Thereby, not only are better trapping abilities provided but the improved valve-assembly herein will provide a better closure with less pasting/adhesive. The invention also takes advantage of the adhesive effectiveness of well known starch based adhesives for affixing the valve assembly to the plies of the paper bag, which adhesive is preferable in the paper bag making industry since hot melt glues or sonic sealing is not required.

The prior art valve assembly as shown in said German Patent No. DE2935971 provides an upper sub-assembly, or insert, that has over-lying flush-cut paper and plastic film members. The present invention improves upon this by reducing the amount of material required for the valve assembly by longitudinally stepping back one of the members at an upper or first sub-assembly.

Accordingly, it is a primary goal of the invention to provide a four member valve closure assembly comprising a first, or upper, two member sub-assembly nestable within a second, or lower, two member sub-assembly to substantially eliminate sifting from the valve during and after filling. It is accordingly an additional goal of the invention to provide such a valve assembly that achieves superior self-closing capability as the bag reaches and becomes filled with a product.

It is also an allied goal of the invention to attain superior strength due to an improved folded arrangement for the valve members. It is an additional goal to achieve this strength while still affording excellent self-closure due to improved inner member pliability as the filling product is forced against the valve assembly during bag filling and valve closure. It is a concomitant goal to provide improved sift-proofness by virtue of a lateral and longitudinal stepping design and formation of product-trapping pockets.

It is the further goal of the invention to provide a self-closing sift-proof valve assembly that may be used with very finely comminuted products of less then one micron in particle size, such as found in carbon black. Accordingly, the invention provides sift-proofness and self-closablity for products ranging from course granulated material, such as salt, or sugar, down to powdered milk sized granulation and even to these very fine particle sizes of less then one micron.

SUMMARY OF THE INVENTION

The invention comprises a four piece or four member assembly folded inwardly and stepped to allow innermost extensions to be lightweight and single ply for supple pliability during closure. Inward folds are created on all of the members to create traps or pockets to stop product loss and sifting outwardly of the valve. Folded marginal lateral and stepped edges enhance strength and achieve the elimination of channeling alongside the valve assembly between the valve assembly and the folded paper plies of a pasted valve bag. The valve assembly improves the filling process by allowing valve detection by the fill spout to be more accurate and provide less drag resistance to minimize the possibility of rupture during product filling. This also allows for the filing cycle to be ended with the spout removed in an easy non-tearing fashion. The invention also provides for improved bonding of the underside of the valve assembly to the corner tuck or corner ear of the valve opening at the satchel end of a bag.

The valve assembly has a first sub-assembly marginally nested within a second subassembly and forming between the sub-assemblies a passageway for the product-injecting spout or nozzle. The first sub-assembly has two members that are folded longitudinally at fold lines to provide inwardly directed trapping pockets and wherein an outer member captures an inner member at the longitudinal folds thereof Both are sized to create a large transverse overlap of greater than fifty percent of the sub-assembly, whereby the sub-assembly is also marginally folded at opposite lateral fold lines to fold over itself for a majority portion thereof. The outer and inner members are stepped both longitudinally and laterally of each other to provide for enhanced bonding, thereby achieving strength and securement within a valve opening of the satchel end of the bag. The second sub-assembly similarly comprises outer and inner members that are longitudinally folded to form trapping pockets and nested at said fold. The second sub-assembly members have a width whereby to also provide for lateral folding over a major portion of the second sub-assembly and wherein the lateral folds of the second sub-assembly capture the lateral folds of the first sub-assembly. The two members of the second sub-assembly are also stepped laterally and longitudinally to achieve increased and therefore improve bonding surface contact for securement within the valve opening of the bag. All four members are also stepped laterally with respect to each other whereby to expose bonding surfaces for the securement to a bag.

The members of the first sub assembly are greater in width then the respective inner and outer members of the second sub-assembly. In preferred form, both of the sub-assemblies have inner members that extend bag inwardly to create flap-valve closure extensions that extend inwardly past bag-inward edges of said outer members of the sub-assemblies.

The large overlapping of the members of each of the first and second sub-assemblies provides for smaller gaps between opposing lateral edges than have been provided in prior art four member type constructions in order to achieve enhanced strength, superior sift-proofness, improved bonding within the valve opening of the bag, and increased regidification at the corner tuck or ear of the satchel end at which the valve assembly is attached. The overlapping may be up to about ninety percent for the first sub-assembly and up to eighty percent for the second subassembly.

In the preferred embodiment, all of the four members are made of paper. In another embodiment the inner members of both the first and second sub-assemblies are made of a thin plastic film. In another embodiment only one of the inner members of the sub-assemblies is made of a thin plastic film, while the other three members comprise paper.

It is further envisioned that with the utilization of an all paper valve assembly, the flap valve extensions formed by the inner members of the first and second sub-assemblies will comprise a thinner, more pliable paper than the outer members of the sub-assemblies.

DETAILED DESCRIPTION OF THE INVENTION

Figure 1:
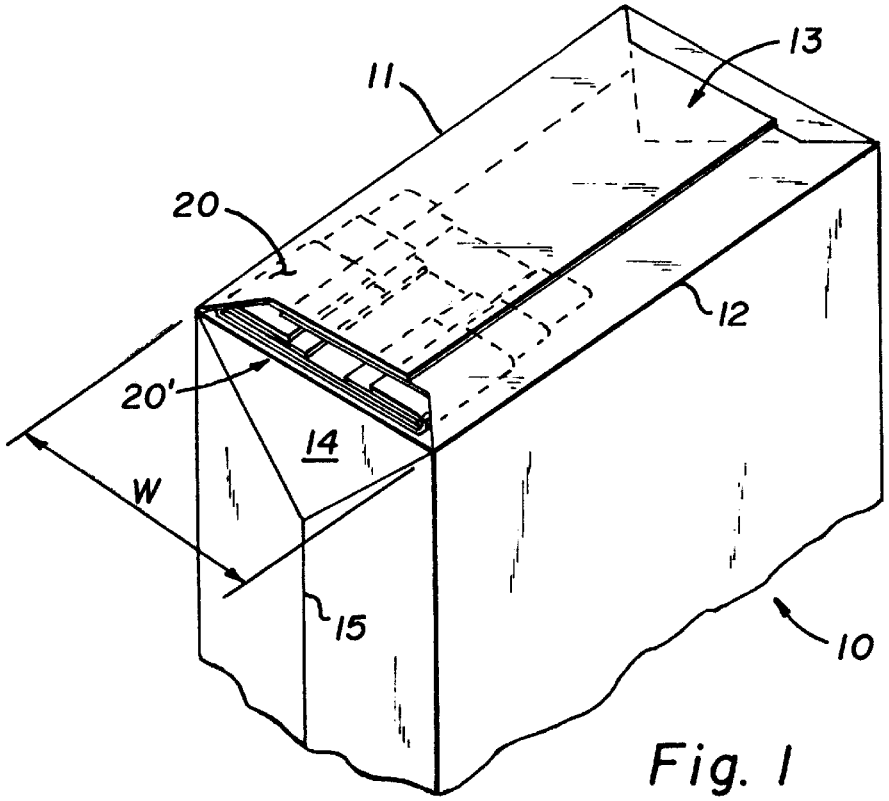
FIG. 1 is a perspective view of a satchel end of a pasted valve bag having the valve assembly of the invention therein and showing the bag in a filled condition wherein the satchel end assumes a generally rectangular-configuration when the bag is filled.

The invention will now be described in greater detail in regard to the preferred embodiment wherein like reference numerals and letters refer to the same elements throughout.

Figure 1A:
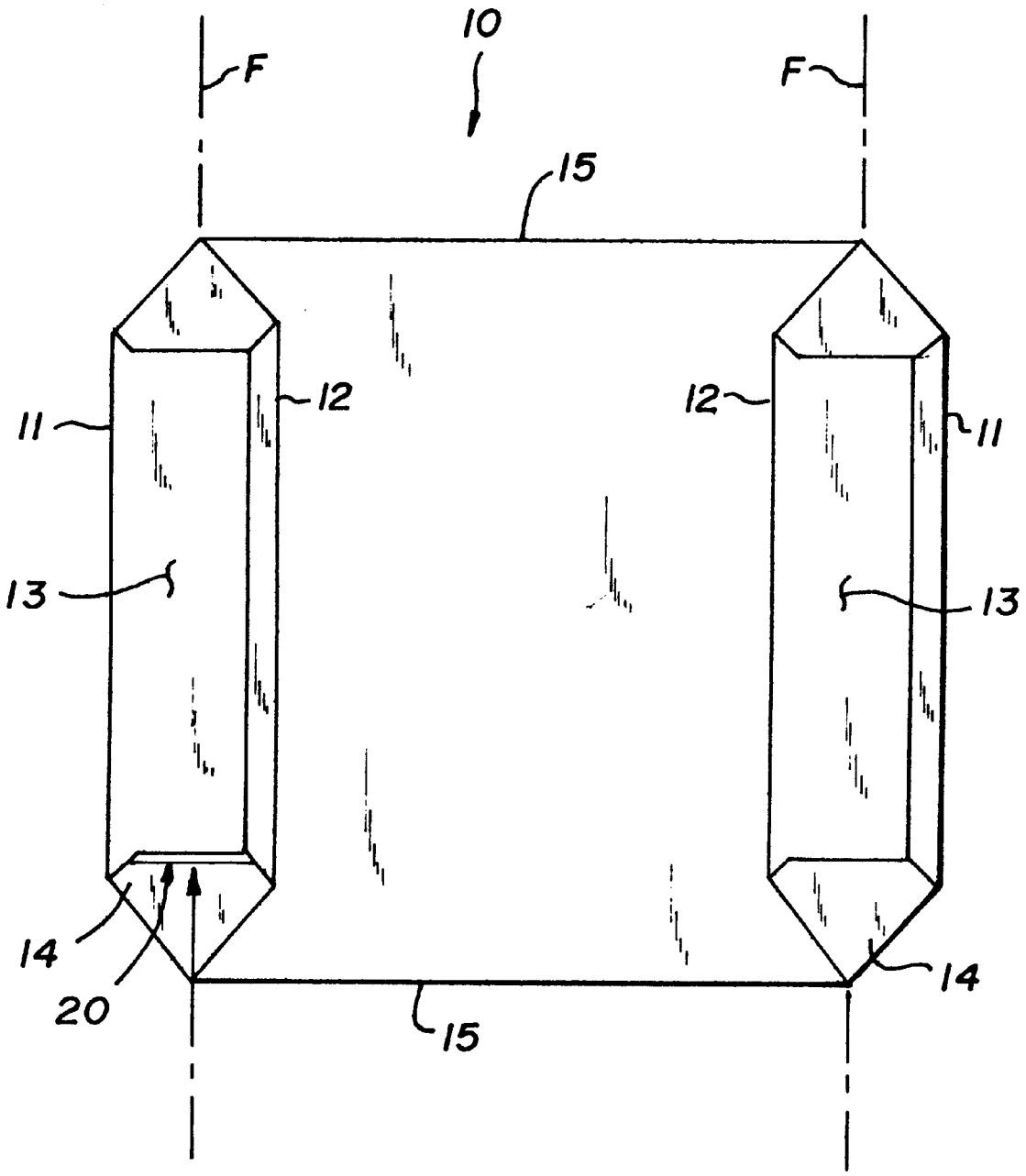
FIG. 1A shows a typical pasted valve bag with opposite satchel bottom ends wherein the valve assembly of the present invention is provided at a valve opening side at one of said satchel bottom ends, as in FIG. 1, and illustrating the bag in a flattened empty condition prior to filling.

With reference first made to FIGS. 1 and 1A, it will be seen that the invention is directed toward providing a self-closing valve assembly for a valve bag 10 having at opposite ends parallel fold lines 11 and 12 defining therebetween a satchel end 13 at either end of the bag 10. In this embodiment, the bag 10 includes diamond shaped corners 14 which are formed by tucks or folded-in ears of paper plies that make up the tubular bag 10 as will be discussed in further reference to FIG. 6. Side edges 15 of the bag extend from the diamond corners 14 wherein the bag 10, in the unfilled state, is flat by virtue of the satchel ends 13 being folded at fold lines F to lie against the bag 10, thus allowing bundles of bags to be shipped in a flat pelletized arrangement.

The self-closing valve assembly of the invention is generally denoted at reference numeral 20 and extends across full width W defining the width of the satchel end 13. The valve assembly 20 is provided at one side of one of the satchel ends 13, is openable bag-outwardly. The valve assembly is adhesively secured and folded with paper plies of the bag 10 inside an opening 20', which opens to the inside of the bag 10 from this valve side of the satchel end 13.

In FIG. 1, the bag 10 is shown in a filled condition whereby the diamond corners 14 are co-planar with the edge 15 which has moved outwardly thereby forming a rectangular shape for the satchel end 13 when in the filled condition. The valve opening 20' of the bag paper plies is also generally co-planar with the adjacent diamond corner 14.

Figure 2:
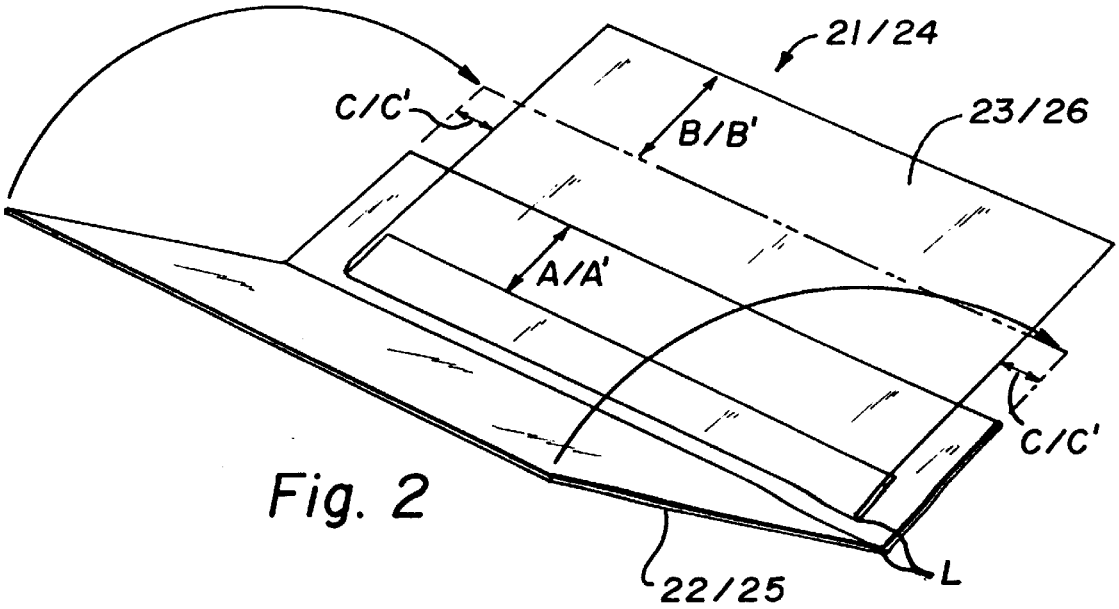
FIG. 2 shows how either a first or second sub-assembly of the present invention is longitudinally folded by folding an outer member over an inner member.
Figure 3:
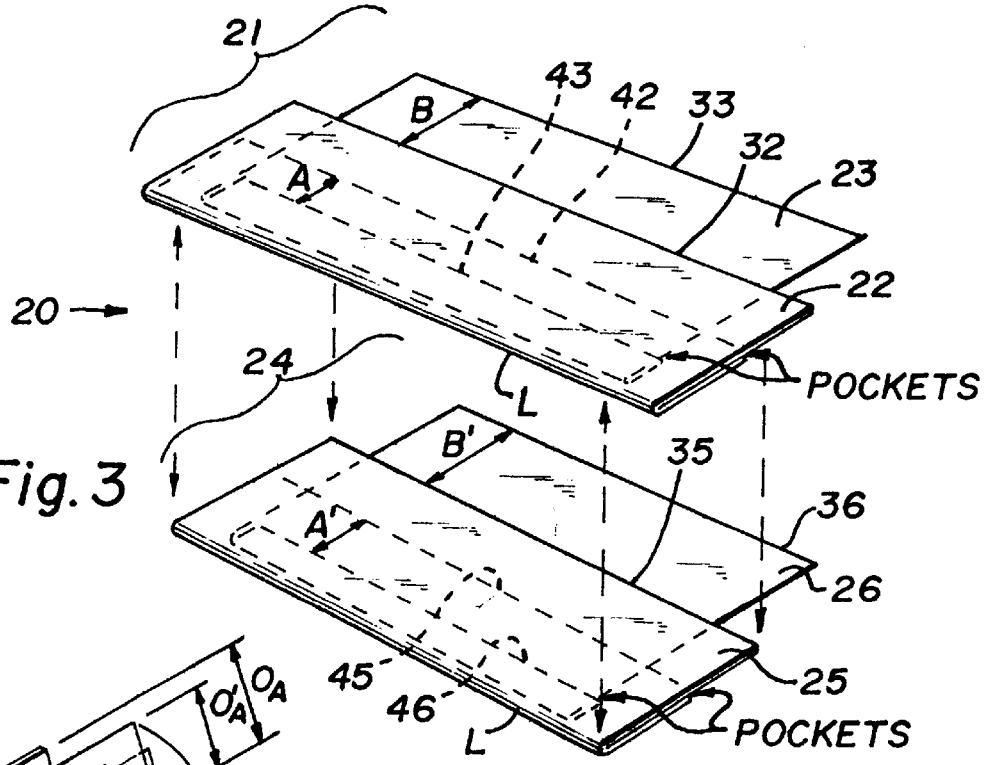
FIG. 3 shows the first and second sub-assemblies having said longitudinal folds completed and positioned for disposition against each other in the manner in which they would be placed during the satchel bottom forming for a pasted valve bag.

With reference to FIGS. 2 and 3, it will be understood that the valve assembly 20 is comprised of first (upper) and second (lower) sub-assemblies 21 and 24 respectively. The sub-assemblies 21 and 24 each have two ply-like members or pieces denoted, respectively as outer member 22 and inner member 23 of the upper or first sub-assembly 21 and outer member 25 and inner member 26 of the lower or second sub-assembly 24. FIG. 2 illustrates the identical folding of the sub-assemblies 21 and 24 along fold lines L to longitudinally fold the two members thereof. Specifically, sub-assembly 21 has both the members 22 and 23 folded generally along a longitudinal fold line L. Similarly, sub-assembly 24 has its members 25 and 26 longitudinally folded over also generally along the fold lines L. FIG. 2 further illustrates the offsetting of inward edges of the members 22, 23 at offsets, or steps, A, B, respectively, and inward edges of the members 25, 26, at offsets, or steps, A', B' respectively. Lateral offsets C denote the lateral or transverse stepping members of the outer and inner 22, 23, and lateral offsets C' denote the lateral or transverse stepping of the outer and inner members 25, 26. In greater detail, it will be seen that the outer member 22 of the sub-assembly 21 has bag-inwardly directed edges 32 and 42. The edge 32 extends farther bag-inwardly than 42, as will be seen in further reference to FIG. 7. The inner member 23, is defined as inner by virtue of being folded within the longitudinal folding of the outer member 22, and similarly has bag-inward edges 33 and 43, wherein the edge 33 extends farther bag-inwardly than 43. The edges 42 and 43 are stepped from each other at said offset A and the edges 32 and 33 are stepped at set offset distance B.

Similarly, the outer member 25 of the sub-assembly 24 has bag-inwardly directed edges 35 and 45. The edge 35 extends farther bag-inwardly than the edge 45. The outer member 25 is folded over the inner member 26, wherein the inner member 26 has two bag-inwardly directed edges 36 and 46. The edge 36 extends further bag inwardly then the edge 46. These members 25 and 26 are stepped at the offsets A' and B', wherein A' is a stepped distance between the edges 45 and 46, and the edges 36 and 35 are stepped at the offset B' distance.

In both the sub-assemblies 21 and 24 the inner and outer members have different widths, thereby providing said lateral or transversely spaced, offsets C and C', respectively, as shown in FIG. 2. Further in accordance with the invention, the widths of the respective outer members 22 and 23 of sub-assembly 21 are greater than the widths of the respective outer and inner members 25 and 26 of the sub-assembly 24, whereby within further reference to FIG. 5, it will be seen that the widths of the four members are progressively smaller beginning with member 22 being the widest, 23 the second widest, 25 the third widest, and the narrowest being member 26. Thus, the sub-assemblies 21 and 24 each have inner and outer members that are stepped both in the longitudinal and lateral directions. The sub-assemblies 21 and 24 are stepped with respect to each other only laterally in the preferred embodiment. Thus, edges 43, 46, edges 42, 45, edges 32, 35, and edges 33, 36, longitudinally extend, respectively for each pair of edges, the same bag-inward distances (FIG. 7). These lateral and longitudinal steps provide zones of adhesion for the application of preferably a starch based adhesive for bonding the valve assembly 20 within the valve opening 20' of the paper plies of the bag 10, which will be further understood in connection with FIGS. 4–6.

Figure 4:
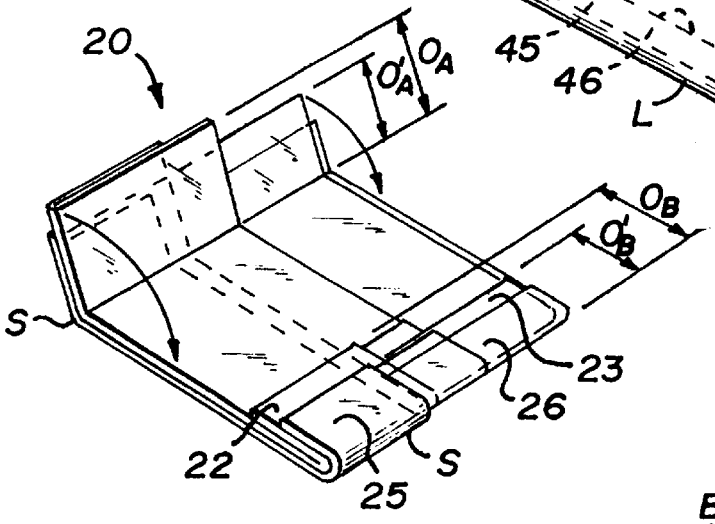
FIG. 4 shows the lateral folding of the first and second sub-assemblies for overlapping themselves and wherein a first or upper sub-assembly is captured within the lateral folds of a second or lower sub-assembly.
Figure 5:
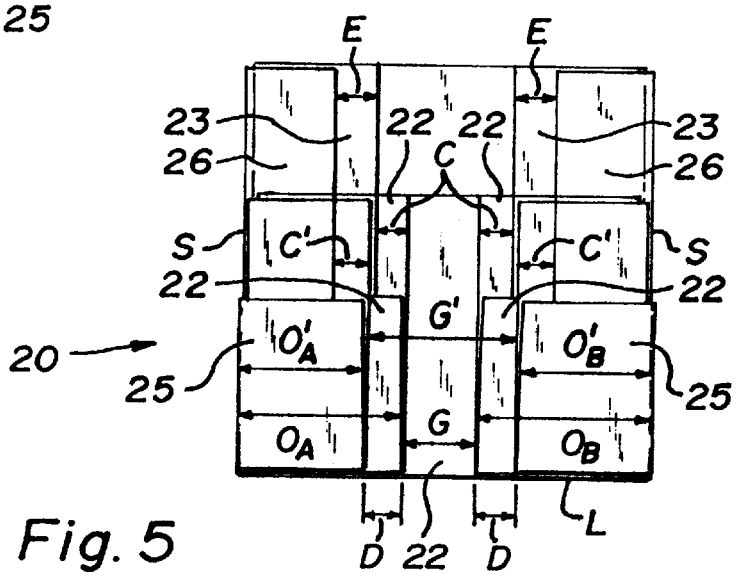
FIG. 5 is a plan view of the longitudinally and laterally folded four member valve assembly of the present invention further illustrating the stepping of all of the plies or members laterally thereof and the bag-inward longitudinal stepping of outer and inner sub-assembly members to each other.
Figure 6:
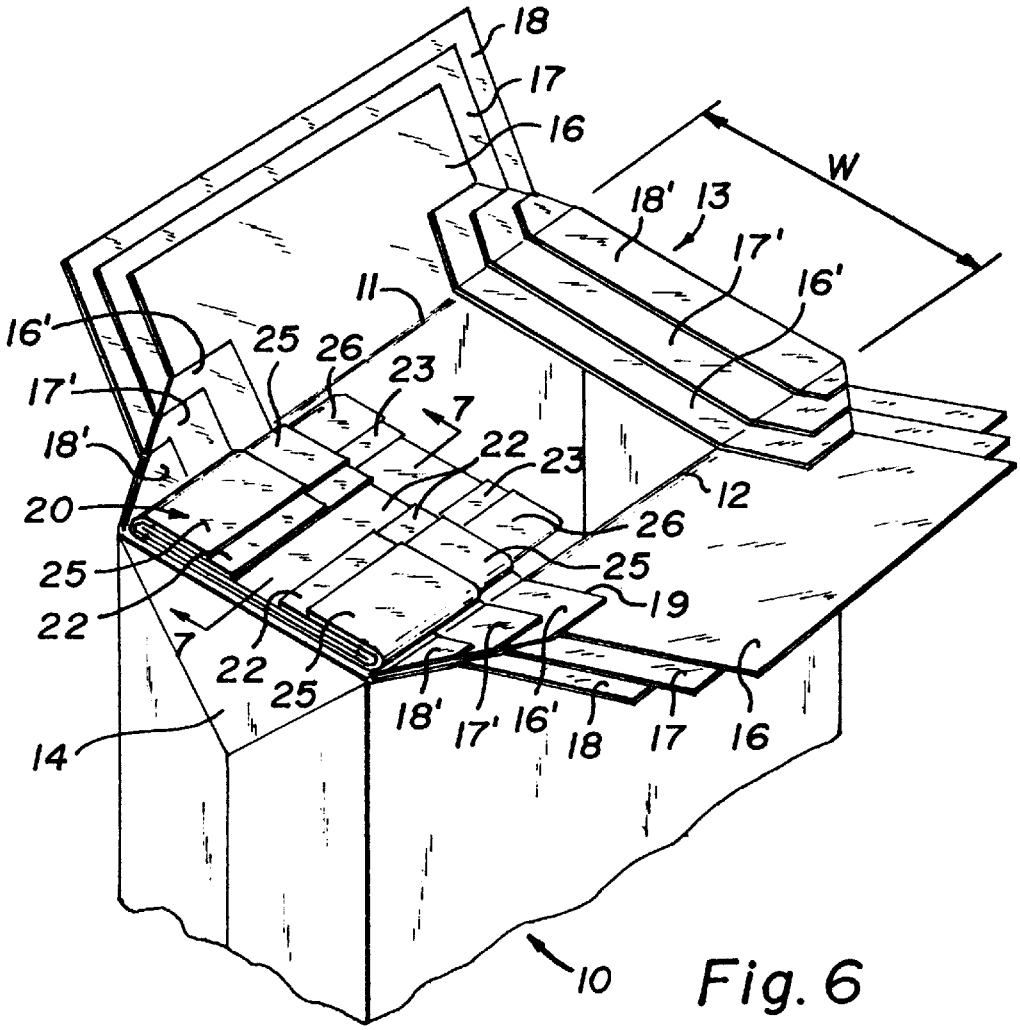
FIG. 6 is a perspective view as in FIG. 1 but showing the satchel end and multi-paper plies of the bag in an open condition illustrating the relationship of the valve assembly within the slit and stepped multi-paper plies of the bag with said valve assembly being located at a corner tuck or ear of a valve-opening side of a satchel bottom end; and, FIG. 7 is a cross-sectional view of the satchel bottom of FIG. 1 showing an injection nozzle inserting product within the bag and extending within a passageway defined between the first and second sub-assemblies of the valve assembly.
Figure 7:
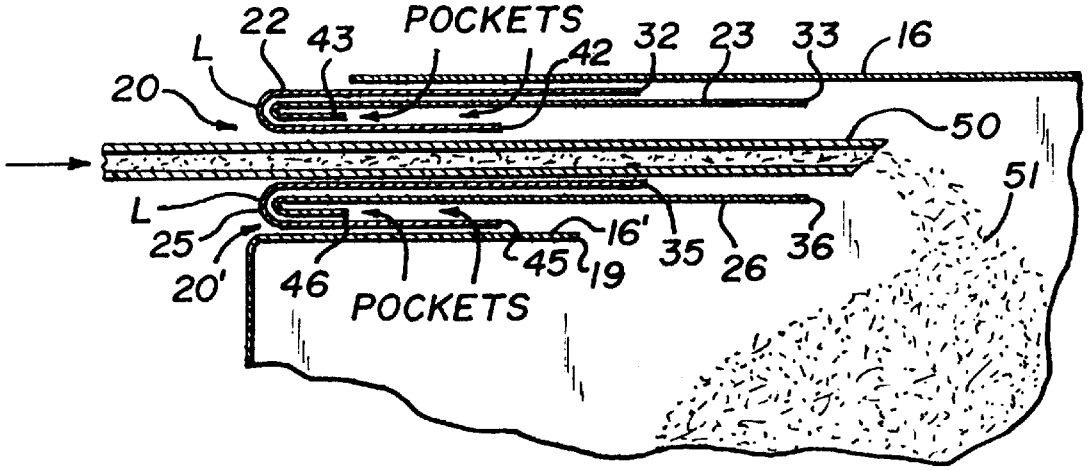

FIGS. 4–6 illustrate the folding of the valve assembly 20 within the valve bag 10. The construction of the valve bag 10 is of a known design wherein it is provided with stepped paper plies 16, 17 and 18, which are slit and inwardly folded to form the diamond corners 14 and inward extending tuck, or ear-like, portions 16', 17' and 18', best viewed in FIG. 6. At a juncture in the bag-making process, before the paper plies 16, 17 and 18 are folded over fold lines 11 and 12, the valve assembly 20 is placed atop the ears 16', 17' and 18' and centered along the center line F of the satchel end 13 as shown in FIG. 1. The valve assembly 20 has side edge fold lines S at opposite marginal edges, which are generally coincident with the fold lines 11 and 12 of the bag 10. A starch based adhesive is placed on the paper plies and the ears 16', 17' and 18' are folded to close the bag in a known way. FIG. 4 shows a folding step in process at one side fold S and at the other side shows a completed folding at the other fold line S. Thus, in reference to FIG. 6, the bag closing folds would first be made around fold line 12 and then a second fold would be made around fold line 11, whereby the valve assembly 20 within the opening 20' reaches the configuration as shown in FIG. 5. The stepping C between the inner and outer members 22 and 23 creates zones of adhesion contact between the sub-assembly 21 and the plies 16', 17' and 18'. The stepping C between inner and outer members 25 and 26 similarly creates zones of adhesive contact between the sub-assembly 24 and the plies 16', 17' and 18'. Reference letters D denote the lateral stepping between the outer members 22 and 25 of the sub-assemblies 21 and 24. Reference letters E denote the lateral stepping between the inner members 23 and 26 of the subassemblies 21 and 24.

Turning to FIG. 5, references $O_A$ and $O_B$ indicate the folding overlaps of the outer member 22 of sub-assembly 21 made at fold lines S. References $O'_A$ and $O'_B$ are the folding overlaps of the outer member 25 of the sub-assembly 24 also made at fold lines S. In the preferred form of the invention, the overlaps $O_A$ plus $O_B$ equal from about 70% up to 90% of the bag width W. The overlaps $O'_A$ plus $O'_B$ equal from about 50% to about 75% of the bag width W. Formed by these overlaps $O_A$, $O_B$, $O'_A$ and $O'_B$ are pockets as noted in FIGS. 3 and 7, which are trapping pockets extending around a majority of the periphery of the valve assembly 20 within the valve opening 20'. These trapping pockets prevent outward blowback and sifting of product filling the bag 10. They prevent channeling of finely comminuted particles alongside the valve assembly 20, particularly along the side folds S.

In the disclosed embodiment, all four members of the valve assembly 20 are comprised of paper, wherein the outer members 22 and 25 are natural kraft paper preferably having a 60 lb. (per 3000 sq. ft.) weight grade. However, the paper may be in a range of from about 40 lb. to about 70 lb. grade. The inner members 23 and 26 are thinner and desirably pliable to effectuate a self-closing flap-valve seal when the product fills the bag and comprise a high performance paper having a weight grade of from about 30 lbs. to about 45 lbs.—optimally from about 32 lbs. to about 43 lbs. It has been found that the configuration for the valve assembly 20 and the utilization of all paper members 22, 23, 25 and 26 achieves excellent results without the prior art requirement of using plastic film flap-valve closure members in a four component valve assembly.

Alternately, the sub-assembly 21 could be constructed as discussed for the foregoing embodiments and the sub-assembly 24 similarly comprise a paper outer member 25 as discussed above, but wherein the inner member 26 thereof is a plastic film, such as thin polyethylene having a gauge of from about 1.0 to about 2.0 mil. (1 mil.=1/1000 inch). In this alternate, the plastic film preferably has a gauge of about 1.25 mil.

In yet another embodiment, both of the inner members 23 and 26 could be made of a plastic film, such as polyethylene, having a thickness in said range of from about 1.0 to about 2.0 mil., with said preferable thickness of about 1.25 gauge achieving optimal results.

With reference to FIGS. 1A and 7, the arrow indicates the direction in which an insert nozzle 50 would be inserted between the sub-assemblies 21 and 24, passing between opposing surfaces of the paper outer members 22 and 25. The nozzle 50 passes the inward edges 42, 45, respectively thereof, to proceed between the bag-inwardly extending portions of the inner members 23, 26 and past a bag inward edge 19 of paper ply 16', which paper ply is the innermost of the multiple plies 16, 17, 18 and extends farthest bag-inwardly. The other plies 17' and 18' shown in FIG. 6 are not illustrated in FIG. 7 for ease of understanding and only the ply 16 at the top and ear part 16' thereof at the bottom being illustrated. The nozzle 50 extends past the inner edges 33 and 36 of the respective inner members 23 and 26, whereupon it may inject a product 51 within the bag 10.

The present inventive valve assembly 20 allows for the product 51 to have a very small particle size, less than one micron, and to be effectively contained within the bag 10 during filling and after the injecting nozzle 50 is extracted. This fineness would be typified by carbon black, or equivalently comminuted material. Of course, larger size particles such as sugar or powdered milk, would be less of a problem because of the larger particle sizes, whereby the invention can be effectively used for fine up to coarsely granulated materials. The trapping pockets, as labeled, seal against the plies 16, 17, 18 of the bag within the open 20' and alongside the side folds S of the valve assembly 20 to prevent leaking or sifting of product 51 outwardly of the opening 20'. As the material 51 is filled into the bag 10, it presses against the inner extension (measured between the edge 33 to edge 32) of the member 26 against the inner extension (measured between the edge 36 to edge 35) of the member 23, which automatically self-closes the valve 20. Additionally, the extensions of the outer members 22 and 25, i.e. the portions extending bag-inwardly past edge 19 of ply 16, would also be pushed to close toward each other beginning at their ends 32, 35 as the product 51 pushes there against. Accordingly, these extension portions of the other members 22 and 25 form supplemental flap-valve closures to the inner member extensions. Thus, it will be seen that the thinner inner members 23 and 26 provide pliable flap-valve closure extensions between the inward edge 32 of the outer member 22 to the inward edge 33 of the inner member 23 for the first sub-assembly 21, and between the inward edge 35 of outer member 25 to the inward edge 36 of the inner member 26 of the second sub-assembly 24.

The bag 10 in the disclosed embodiment has a typical pasted valve bag construction known in the industry wherein the width W is a standard 5½ inches and the bag is usually expected to have a capacity from about 40–60 lbs. for the weight of product 51. As a result, by the formation of the overlaps $O_A$, $O_B$, $O'_A$, $O'_B$, there is a gap G of about one inch between the folded over portions ($O_A$, $O_B$) of the outer paper member 22 and a gap G' of about two inches between the folded over portions ($O'_A$, $O'_B$) of the outer paper members 25. With reference also to FIG. 2, the stepped offsets C between the outer and inner members 22, 23 of the sub-assembly 21 are about one-half inch and the stepped offsets C' between the outer and inner members 25, 26 of sub-assembly 24 are also about one-half inch.

In the disclosed embodiment, the inward edges 42 and 45 of the sub-assemblies outer members 22 and 25, respectively, are substantially co-terminus within the bag, but they could terminate at staggered or stepped distances inwardly of the bag 10. Likewise, the inward edges 33, 36 of the inner sub-assemblies members 23 and 26, respectively, co-terminate at about the same distance inwardly of the bag, but these also could be staggered or stepped.

Of course, the inner members inward edges 33, 36 are needed to extend past the outer members inward edges 32 and 35 in order to provide said flap-valve closure extension portions of the members 23 and 26 to sealingly close against the paper plies of the bag 10 when the product 51 has moved upwardly thereto. It is also preferred that the ends 32 and 35 of the outer members 22 and 25, respectively, extend bag-inwardly for a greater distance than the inward edge 19 of the inner ply 16' in order to smoothly and sturdily support the injection nozzle 50 to be directed inside the bag 10 without rupture or tearing of the plies 16, 17 or 18.

In the disclosed embodiment, for use with a 5½ inches width bag, the valve assembly 20 has a length measured from fold line L to the inner edges 33 or 36 of about 5½ inches. The depths of the pockets for the outer members 22 and 25 as labeled in FIG. 7 are approximately two and one-half inches measured from fold lines L to ends 42 or 45. The smaller pockets of the inner members 23 and 26 are about ¾ inch measured from folds L to the ends 43 or 46. These dimensions are noted for purpose of describing the disclosed embodiment and the invention is not limited thereto. The pockets of the inner members 23 and 26 could be made deeper or slightly shallower and the pockets of the outer members 22 and 25 made deeper or shallower. However, it is preferred that the pockets of the inner members 23, 26 be less deep then the pockets of the outer members, so that their ends 43, 46, do not extend bag inwardly past ends 42, 45, respectively, of the outer members 22, 25.

The total unfolded widths of the sub-assemblies 21 and 24 are substantially greater than the width W of the bag 30 in order to form said overlaps $O_A$, $O_B$, $O'_A$ and $O'_B$. In preferred form, the sub-assembly 21 has a width in the range of from about 1.6 to about 1.9 times width W and the sub-assembly 24 has a width of from about 1.5 to about 1.8 times width W. The subassemblies 21, 24 are provided within these ranges whereby gap G is less than gap G' in order to provide the stepping allowing for an adhesive to be able to bond to the top surfaces of members 22, 23, 25 and 26 as would be understood in connection with FIG. 5.

The bag 30 with the valve assembly 20 provides an effective self-closing valve for satchel-end type pasted valve bags. It permits the bag 30 to fall off the injection nozzle 50 allowing the entry way opening 20' to be cleaned and the product forcing the valve to close. The members 22, 23 of the upper assembly 21 and the members 25, 26 of the sub-assembly 24 are individually stepped within each sub-assembly. The sub-assemblies 21 and 24 have all of the members 22, 23, 25 and 26 stepped transversely with respect to each other for creating effective bonding surfaces, typically achieved through the use of a starch-based adhesive. The flap closure extensions of members 23 and 26 extend past the inward edges of the outer members 22 and 25 for the effective automatic self-closure operability as explained. The trapping pockets formed by the longitudinal folds achieve sift-proofness around the valve. The folded trapping pockets trap escaping product particles both during and after filling. The unique construction envisions the members 23 and 26 to be quite lightweight for supple pliability in achieving an improved self-closure over the prior art.

Quite fine products may be filled and contained within the bag 30 down to particle sizes of less than one micron, such as would be found with carbon black or like-sized material.

These improved features may be achieved by the utilization of an all-paper valve or the utilization of either one or two thin film plastics for use as the inner members 23 and/or 26. The valve assembly 20 enables the bag 30 to be supported for longer periods of time during the fill cycle by virtue of its sturdy configuration. Formation of the plurality of pockets allows for double-trapping sleeve-like configurations achieving superior product seal-off. The construction of the valve assembly 20 achieves less drag resistance on the injector spout or nozzle 50 due to less damage prone material to be in contact with the spout. Because of the configuration, there is more space available at the end of the fill cycle to let the injection nozzle 50 exit more easily, than found in previously known bag valves of this type.

The invention herein has been disclosed in connection with a preferred embodiment but it will be understood that a wide range of equivalents fall within the scope of the claims appended hereto.

What is claimed:

1. A four member valve closure assembly for valve bags comprising:

two sub-assemblies, a first sub-assembly being partially folded within a second sub-assembly, each said sub-assembly comprising two members that are longitudinally folded and longitudinally offset, each said sub-assembly further having marginal side folds at opposite sides thereof, whereby the side folds form overlaps, first sub-assembly overlaps being nested within overlaps of the second sub-assembly, each of said sub-assemblies having one member thereof extending in a direction from said longitudinal fold a greater distance than the other member of each respective sub-assembly, and all of said four members having different widths whereby all are transversely stepped with respect to the other.

2. The four member valve closure assembly for valve bags as in claim 1 wherein all of the four members are made of paper.

3. The four member valve closure assembly for valve bags as claimed in claim 1 wherein at least one of the said members extending said greater distance from said longitudinal fold than its respective other member is made of a non-paper film.

4. The four member valve closure assembly for valve bags as claimed in claim 1 wherein at least one of said members extending said greater distance from the longitudinal fold line than its respective other member is an inner member and the other member is an outer member folded over said inner member at said longitudinal fold.

5. A valve bag comprising:

a tubular bag body having a valve end including at one side thereof an opening having a width, said opening capable of accommodating therein a valve assembly; and, a valve assembly arranged in said opening having:

a first sub-assembly having two nested members having bag inwardly directed trapping pockets and a second sub-assembly having two nested members having bag inwardly directed trapping pockets;

said first sub-assembly having outer and inner members being longitudinally folded at one end to form said bag inwardly directed trapping pockets thereof, wherein a longitudinal fold of the inner member is nested within a longitudinal fold of the outer member, said outer and inner members being folded at marginal opposite lateral fold lines, whereby each said member laterally overlaps a part of itself;

said second sub-assembly having outer and inner members being longitudinally folded at one end to form said bag inwardly directed trapping pockets thereof, wherein a longitudinal fold of the inner member is nested within a longitudinal fold of the outer member, said outer and inner members being folded at marginal opposite lateral fold lines, whereby each said member laterally overlaps a part of itself;

said first sub-assembly lateral folds thereof being nested within the lateral folds of said second sub-assembly, said nested first and second sub-assemblies forming a bag-inwardly openable passageway therebetween;

the outer and inner members of both said sub-assemblies having fold lines of the longitudinal folds disposed substantially at an outer side of said opening and each member having bag inward first and second stepped edges, the second edges being stepped farther bag-inwardly than said first edges;

said second edges of the inner members of the sub-assemblies extending bag-inwardly past the second edges of the outer members and forming flap-valve extensions of said inner members; and said lateral fold lines of the outer and inner members of the sub-assemblies being spaced apart at a distance substantially equal to the width of said opening.

6. The valve bag as in claim 5 wherein the outer members of said first and second sub-assemblies comprise paper.

7. The valve bag as in claim 5 wherein the inner members of said first and second assemblies comprise non-paper film.

8. The valve bag as in claim 5 wherein one of said inner members of said first and second sub-assemblies comprises paper and the other comprises non-paper film.

9. The valve bag as in claim 5 wherein the outer and inner members of said first and second sub-assemblies comprise paper.

10. The valve bag as in claim 9 wherein the outer members are made of kraft paper in the range of from about 40–70 lbs. per 3000 sq. feet and wherein the inner members are made of high performance paper in the range of from 3045 lbs. per 3000 sq. feet.

11. The valve bag as in claim 5 wherein the openable passageway formed by said first and second sub-assemblies includes an outward opening defined upwardly by the longitudinal folds of said first sub-assembly and downwardly by the longitudinal folds of said second sub-assembly.

12. The valve bag as in claim 5 wherein the inner members are made of thin film polyethylene and the outer members are made of natural kraft paper.

13. The valve bag as in claim 5 wherein the second edges of the inner members co-terminate at substantially the same distance inwardly of the bag.

14. The valve bag as in claim 5 wherein the second edges of the inner members are spaced at different distances inwardly of the bag.

15. The valve bag as in claim 5 wherein the inner members of each sub-assembly are less wide then said respective outer members.

16. The valve bag as in claim 15 wherein the widths of the first sub-assembly inner and outer members are greater than the respective widths of the inner and outer members of the second subassembly.

17. The valve bag as in claim 5 wherein the inner and outer members overlap themselves from about 50% to about 90%.

18. A multiple member flap valve closure assembly for use in filling and closing a satchel-end multi-wall bag comprising:

a first sub-assembly having a pair of nested and folded members for extending into a bag, including an outer member folded longitudinally to provide a first nest and laterally folded at opposite sides to provide opposing second nests and an inner member having a longitudinal fold nested within the first nest of the outer member and being lateral folded at opposite sides to provide opposing second nestable folds nested within the opposing second nests of said outer member; and a second sub-assembly having a pair of nested and folded members for extending into a bag, including an outer member folded longitudinally to provide a first nest and laterally folded at opposite sides to provide opposing second nests and an inner member having a longitudinal fold nested within the first nest of the outer member and being laterally folded at opposite sides to provide opposing second nestable folds nested within the opposing second nests of said outer member;

said second sub-assembly having said lateral folds folded over the lateral folds of said first assembly whereby said first assembly is nested within said second assembly lateral folds;

said first and second sub-assemblies having extensions of the inner members forming valve closure flaps for closing a bag and said outer members having bag inward extensions extending for a lesser distance bag inwardly then said inner members and forming supplemental valve closure flaps for closing a bag; and said first and second sub-assemblies forming a longitudinal passageway therebetween for receipt therethrough of a product-injecting means for injecting product into a bag.

19. The multiple member flap valve closure assembly as claimed in claim 18 wherein said longitudinal folding of said inner and outer members form trapping pockets for preventing leakage of product out of a bag.

20. The multiple member flap valve closure assembly as claimed in claim 18 wherein said flap-valve closure assembly is self-closing after product has been filled into a bag.

21. In combination:

a valve bag; and two valve sub-assemblies, a first sub-assembly being partially folded within a second subassembly, each said sub-assembly comprising two members that are longitudinally folded and longitudinally offset, each said sub-assembly further having marginal folds at opposite sides thereof whereby the folds form overlaps, said first assembly being nested within the overlaps of the second sub-assembly, each of said sub-assemblies having one member thereof extending in a direction from said longitudinal fold a greater distance than the other of said members of each respective sub-assembly, all of said four members having different widths whereby all are transversely stepped.

22. The combination as claimed in claim 21 wherein all of the four members are made of paper.

23. The combination as claimed in claim 21 wherein at least one of the said members extending a greater distance from the longitudinal fold line than its respective other member is made of a non-paper film.

24. The combination as claimed in claim 21 wherein in said sub assemblies, the member extending a greater distance from the longitudinal fold line than its respective other member is an inner member folded within said other respective member at said longitudinal fold whereby said other respective member is an outer member.

* * * * *